United States Patent [19]

Bradshaw

[11] 4,253,821

[45] Mar. 3, 1981

[54] METHOD AND DUCTING SYSTEM FOR HOT GAS HEAT RECOVERY

[75] Inventor: Norman F. Bradshaw, Surrey, England

[73] Assignee: Schweitzer Industrial Corporation, Madison Heights, Mich.

[21] Appl. No.: 971,851

[22] Filed: Dec. 21, 1978

Related U.S. Application Data

[63] Continuation-in-part of Ser. No. 929,362, Jul. 31, 1978, abandoned.

[51] Int. Cl.[3] ..... F24D 23/02; F26B 19/00

[52] U.S. Cl. ..... 432/2; 34/85; 34/86; 98/115 SB; 432/72

[58] Field of Search ..... 432/2, 72, 67; 34/72, 34/85, 86; 98/115 R, 115 SB

[56] References Cited

U.S. PATENT DOCUMENTS

| | | | |
|---|---|---|---|
| 1,539,588 | 5/1925 | Muller | 34/86 |
| 1,731,290 | 10/1929 | Boltz . | |
| 2,140,337 | 12/1938 | Somes . | |
| 2,852,109 | 6/1958 | Pine . | |
| 2,889,763 | 6/1959 | Pine . | |
| 3,115,819 | 12/1963 | Mahlmeister et al. . | |
| 3,251,139 | 5/1966 | Strimling . | |
| 3,307,272 | 3/1967 | Maynard . | |
| 3,376,834 | 4/1968 | Thoren . | |
| 3,626,837 | 12/1971 | Pelosi, Jr. et al. | 98/115 R |
| 3,670,666 | 6/1972 | Herman | 432/72 |
| 3,994,210 | 11/1976 | Davis | 432/72 |
| 4,031,631 | 6/1977 | Robinson | 34/85 |
| 4,072,141 | 2/1978 | Fillios . | |
| 4,160,407 | 7/1979 | Duym | 98/115 R |
| 4,164,819 | 8/1979 | Devillard | 34/72 |
| 4,176,162 | 11/1979 | Stern | 431/5 |

*Primary Examiner*—John J. Camby
*Attorney, Agent, or Firm*—Krass & Young

[57] ABSTRACT

A method and ducting system for collection of hot exhaust gases from paint curing oven heaters is disclosed for heat energy recovery in which a large collector duct is extended above the paint curing oven and into which is drawn large volumes of slightly warmed air heated by radiation from the paint curing oven or from secondary warm air sources. The vent stack of each paint curing oven heater is extended into the interior of the collector duct, directing the hot exhaust gases into the center of the large volume air stream in order to cool the gases and allow the collection without the need for insulated collection ducting, thermal expansion joints or flow balancing dampers. The heated air volume is passed through the heat recovery exchanger unit prior to being exhausted to the atmosphere. In one alternate version, the collector duct is mounted directly to the roof of the paint curing oven and in communication with an air space formed in the roof and side wall panels, which collects air heated by the roof and walls, as well as any gas leakage from the interior of the oven. In another variation, a positive pressure is created in the air space to preclude leakage from the oven interior.

14 Claims, 8 Drawing Figures

Fig-6
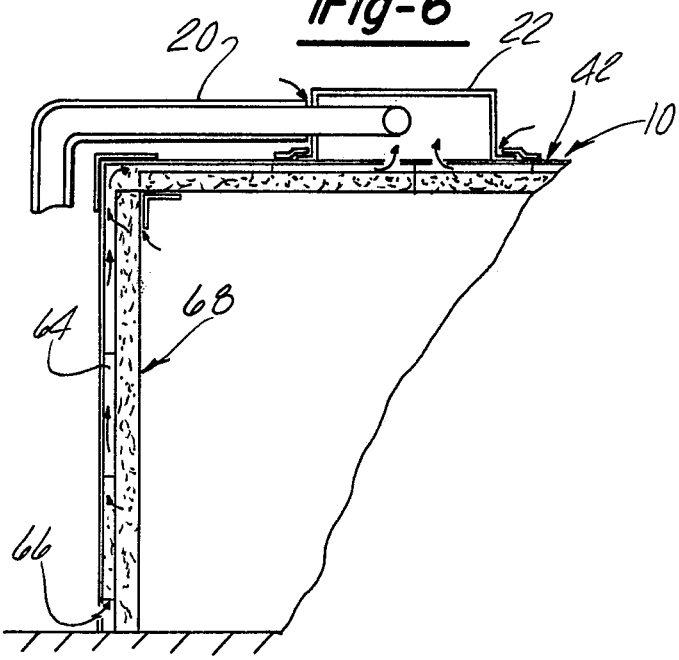
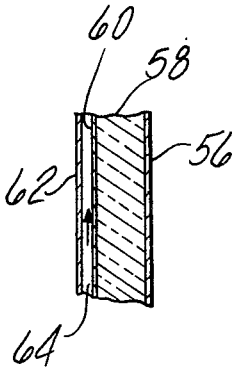
Fig-7
Fig-8
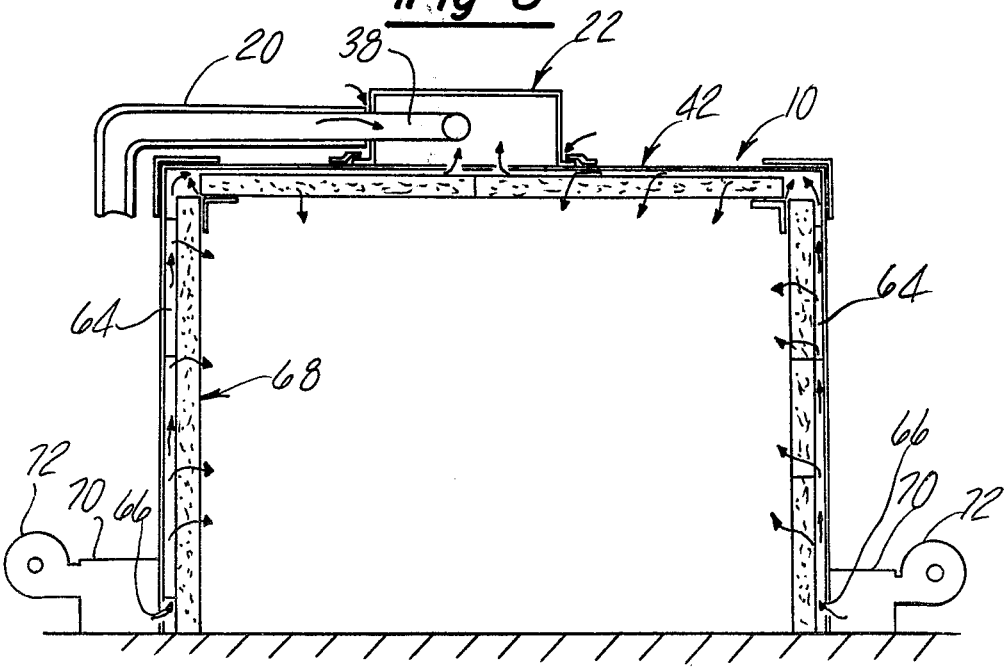

METHOD AND DUCTING SYSTEM FOR HOT GAS HEAT RECOVERY

CROSS REFERENCE TO RELATED APPLICATION

This application is a continuation-in-part of Ser. No. 929,362, filed July 31, 1978, now abandoned.

BACKGROUND DISCUSSION

Increased emphasis in recent years on the energy efficiency of industrial processes has led to efforts to partially recover the enormous expenditures of energy required in paint finishing operations on automotive production lines. Such energy recovery efforts are coupled with increasingly stringent requirements to reduce the pollutants produced by such industrial processes.

One aspect of the paint finishing operation which consumes a particularly heavy share of the total energy required is the paint curing oven, wherein the painted surfaces are cured after application of the paint by being passed through ovens having radiator surfaces heated by the use of gas or other fuel-fired heaters.

Traditionally, the products of combustion in a fuel-fired heater would be individually vented or exhausted through the atmosphere passing upwardly and through the roof of the factory. Many modern large automotive manufacturing facilities having a large number of paint curing oven heaters space them along the length of the curing oven. The individual venting of each heater represents a considerable expense since the roof must be penetrated for each vent and flashing and other hardware installed. The resultant installations are also expensive to maintain.

The shop area around the ovens must also be ventilated since the radiation of heat from the ovens is considerable, and also some leakage of fumes is inevitable, thus requiring additional roof vents.

In addition, if any filtering or other treatment of the exhaust gas is required, the number of individual treatment installations would render the treatment of the exhaust gases to be impractical or inordinately expensive. If the recovery of the heat energy in the exhaust gases were attempted by collection of the gases into a common ductwork, the length of such installation, as well as the relatively high temperature of these exhaust gases, i.e., 300°–750° F., would entail considerable capital expense. This is in part due to the need to provide a costly and complex ducting system, since such ductwork should be insulated to minimize the substantial heat loss which would otherwise occur due to the relatively elevated temperature of the exhaust gas. Also, the considerable thermal contraction and expansion of the ducting undergoing such wide temperature variations indirectly receiving such hot gases requires the use of elaborate thermal expansion compensating connections.

Finally, the need to maintain the proper back pressure in each exhaust stack, while compensating for changes in flow which would occur by shutting off individual heaters, creates the need for costly flow balancing dampers in the duct system.

There are many other lower grade heat sources in industrial installations from which additional heat energy could be potentially recovered. However, the potential energy may be insufficient to justify the capital expenditure. For example, the air above the paint curing ovens is generally heated by radiation to relatively modest temperature levels, i.e., of 95° F. As another example, cascade body coolers are commonly employed in which air is successively recirculated in stages over the vehicle car bodies as they pass through the cooler. The air is then exhausted to the atmosphere at a temperature well above ambient levels, but much cooler than the heater exhaust gases.

Accordingly, it is an object of the present invention to provide a relatively low cost ducting system for the recovery of heat contained in relatively high temperature gases such as exhaust gases from fuel-fired heaters such as are in paint curing ovens.

It is another object of the present invention to provide such a ducting system which also provides for the simultaneous recovery of heat energy from relatively lower grade heat sources.

It is a further object of the present invention to provide such a heat recovery system for a paint curing oven which also acts to prevent leakage from the oven interior and thereby reduces the ventilation requirements for installations within a shop building.

SUMMARY OF THE INVENTION

These and other objects of the present invention, which will become apparent upon a reading of the following specification and claims, are achieved by drawing the hot exhaust gases into a large cross sectional area collector duct passing over the paint curing ovens, through which is also drawn a large volume of relatively cooler air or other gas from secondary heat sources to reduce the temperature of the mixture of gases sufficiently to enable the use of a relatively inexpensive, uninsulated collector duct, which does not require the use of thermal expansion joints nor flow balancing dampers. The secondary heat sources may comprise moderately warmed room air heated by radiation from the paint curing ovens or from the body coolers.

The warm gas flow is passed through a recovery heat exchanger unit prior to being exhausted to the atmosphere.

In one alternate version, the collector duct is secured directly to the roof of the paint curing oven, and in communication with an air space extending about the oven walls and roof, such that air warmed by the walls and roof as well as any leakage gases are drawn into the collector duct.

In another variation, a positive pressure is created in the air space to preclude such gas leakages.

DESCRIPTION OF THE DRAWINGS

FIG. 6 is a fragmentary sectional view of a paint curing oven incorporating another variation of the ducting system according to the present invention.

FIG. 7 is an enlarged view of the wall section of the paint curing oven shown in FIG. 6.

FIG. 8 is a sectional view of a paint curing oven depicting a ducting system modification of the system depicted in FIG. 6.

DETAILED DESCRIPTION

In the following detailed description, certain specific terminology will be utilized for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
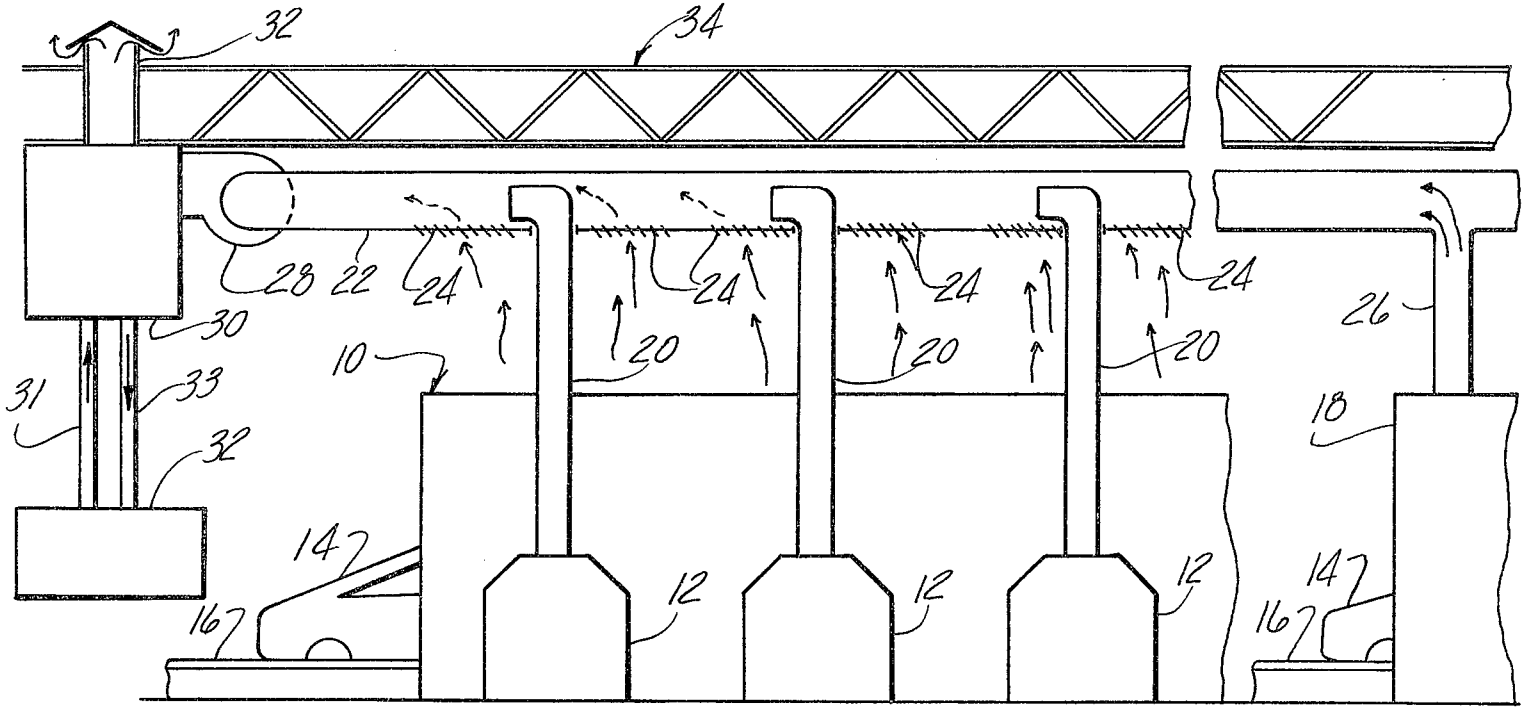
FIG. 1 is a diagrammatic representation of an installation incorporating a duct system of the present invention.

Referring to the drawings and particularly to FIG. 1, the system is depicted as applied to an automotive paint finishing installation. In this installation, a paint curing oven 10 is provided with a plurality of fuel-fired oven heaters 12 disposed spaced along the length of the paint curing oven. Since such ovens may be of considerable length, i.e., 300 feet or more, a number of such oven heaters 12 are normally required.

The car bodies 14 are caused to pass through the length of the paint curing oven 10 on a conveyor 16 or other similar equipment. After passing through the interior of the paint curing oven 10, the car bodies 14 pass into a body cooler enclosure 18 in which the heated car bodies 14 are cooled by a cascade flow arrangement of air circulated through the body cooler enclosure 18 in a manner well known in the art.

According to the concept of the present invention, the exhaust gases from each of the oven heaters 12 are collected in the ducting system, which includes the vertical vent stacks 20, extending from each of the oven heaters 12, each in turn communicating with a relatively large cross sectional area collector duct 22. The collector duct 22 extends over the paint curing oven 10, along the length thereof, so as to be in position to be connected to each of the vent stacks 20.

Collector duct 22 is also provided with inlet registers 24 at spaced points along the length thereof so as to allow the induction of the relatively warm shop air which has been heated by radiation from the paint curing oven 10.

In addition, warm air or gases from other secondary heat sources in which are generated warmed air of a relatively moderate temperature may be collected in the collector duct 22, as for example, the discharge air passing through an exhaust duct 26 which receives the air passed over the car bodies 14.

The inducted flow into the collector duct 22 is achieved by the use of a circulation blower 28 acting at the discharge end of the collector duct 22 such as to draw in the warm air flow and through the inlet registers 24 and the vent exhaust gas flow from the vent stacks 20.

The warm mixture is passed through a recovery heat exchanger unit 30 which may also incorporate the necessary filtering or other pollution central devices prior to being discharged through an exhaust stack 32 passing through the building roof 34.

The heat recovered in the heat exchanger unit 30 is transferred as by a liquid circulation in lines 31 and 33 to suitable utilization equipment as in conjunction with the air conditioning equipment associated with the paint spray booth.

Such systems utilizing recovered low grade waste heat are disclosed in copending applications, Ser. No. 882,345, filed Mar. 1, 1978 and Ser. No. 887,156, filed Mar. 16, 1978.

Figure 2:
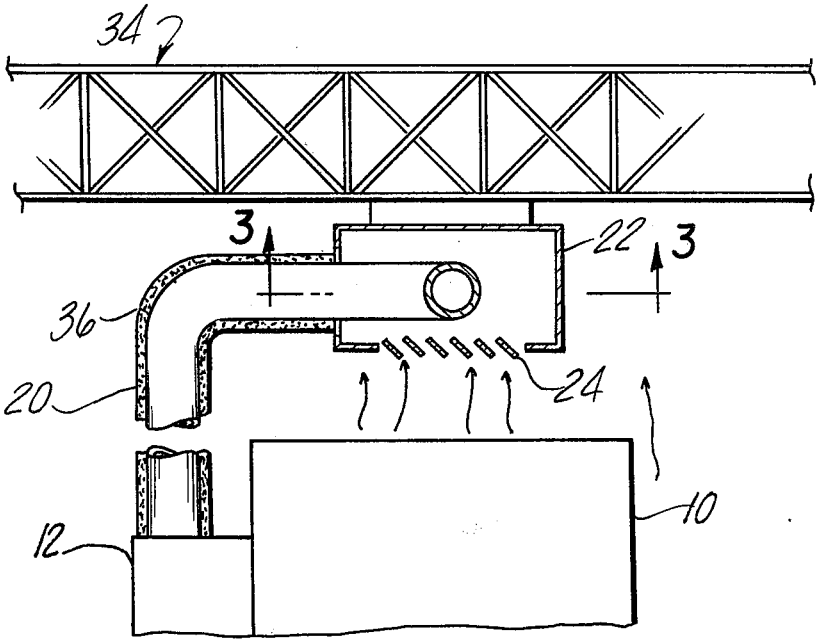
FIG. 2 is an enlarged view of an individual section of the ducting system showing the details of the joint between the exhaust vent stack from each of the fuel-fired heaters and the collector duct.
Figure 3:
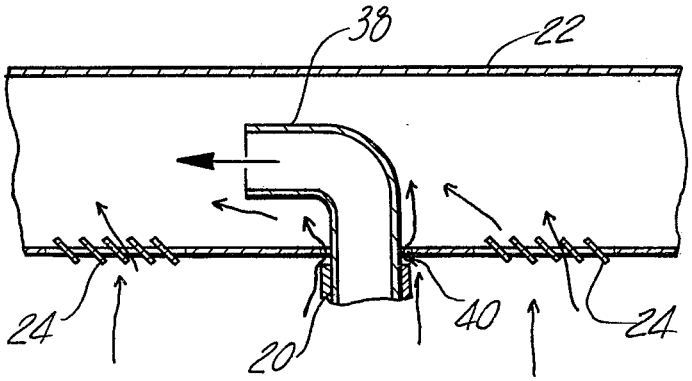
FIG. 3 is a sectional view taken along the lines 3—3 of FIG. 2.

Referring to FIGS. 2 and 3, the details of the installation of the vent stacks 20 with the collector duct 22 is depicted. Each section of the vent stack 20 is preferably insulated along its length as by an insulator sleeve 36. Each vent stack 20 is preferably provided with an elbow positioned in the interior of the collector duct 22.

A terminal elbow fitting 38 serves to introduce the exhaust gases into the air flow within the collector duct 22 centrally of the collector duct 22 and directing it in a direction aligned with the direction of flow induced by the circulation blower 28.

This assures a good mixing of the exhaust gases and avoids the development of excessive heating of the collector duct 22 to a relatively elevated level.

The terminal elbow fitting 38 is also provided with a relatively loose fit as by the clearance 40 between each elbow 38 and the sidewall of the collector duct 22 and allows for the clearance required to compensate for contraction and expansion of the ducting.

In addition, if an individual oven heater 12 is not operated, the absence of the exhaust gases from a given one of the vent stacks 20 will not imbalance the flow or create an undesirable change in the static pressure within the collector duct 22 since additional inflow will be inducted through the clearance space (as well as being taken in by extra flow through the inlet registers 24).

Accordingly, the method and duct system provides for collection of the hot gases by a relatively low cost ducting system, since the high temperature gases are diluted with the moderate temperature air flow induced by the drawing in of shop air and/or air from waste heat sources in which the air is much more modestly heated. This dilution produces relatively moderate temperature levels in the air exhaust gas mixture flowing in the collector duct 22, such that ducting can be uninsulated and the use of expansion joints, etc., are not required even for very long runs of the ducting.

In addition, the arrangement whereby the flow is drawn in by a circulation blower 28 at the collection end of the ducting eliminates the need for use of special balancing damper systems to make certain that the proper back pressure conditions are contained in each of the oven heaters 12 and allows a loose fit of the vent stacks 20 and the collector duct 22.

This arrangement therefore allows the recovery of substantial energy from such installations without entailing the considerable capital expense which would be required by conventional methods.

In addition, the use of the centralized recovery system eliminates the need for numerous exhaust stack installations, both for venting of the shop air and for the exhausting of the gases from the fuel-fired oven heaters such that there is realized a substantial savings in the cost of such installations tending to offset the cost of the heat recovery equipment.

While this system and method have special application to paint curing ovens, it is to be understood that the same could be applied to other systems in which relatively hot gases are to be collected through ducting which must extend over considerable distances and also that the secondary heat sources may come from any number of suitable waste heat sources as are very typically present in industrial installations.

Figure 4:
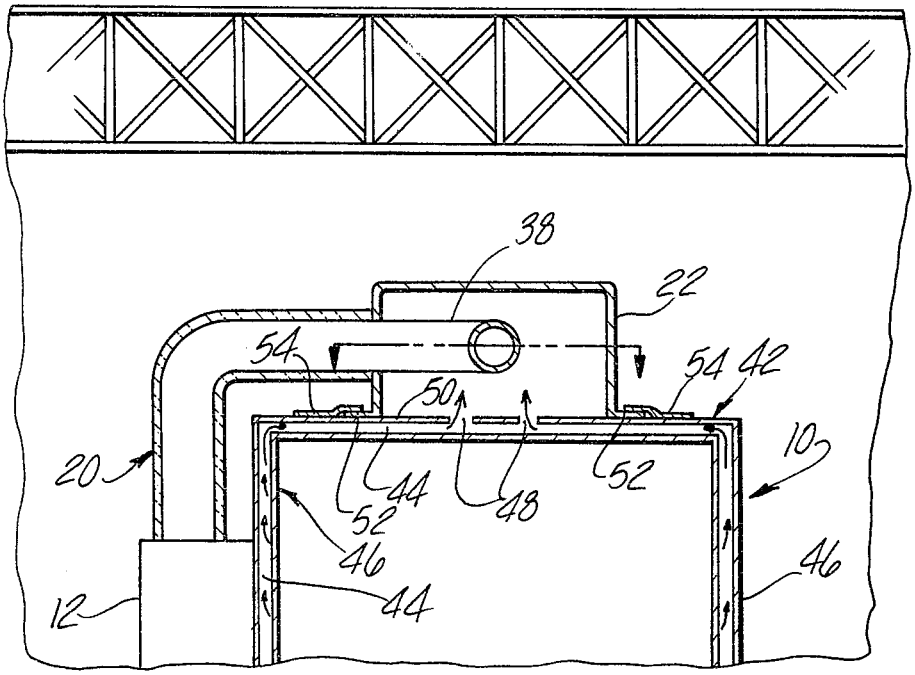
FIG. 4 is a sectional view of a paint curing oven incorporating one variation of the ducting system depicted in FIGS. 1 through 3.
Figure 5:
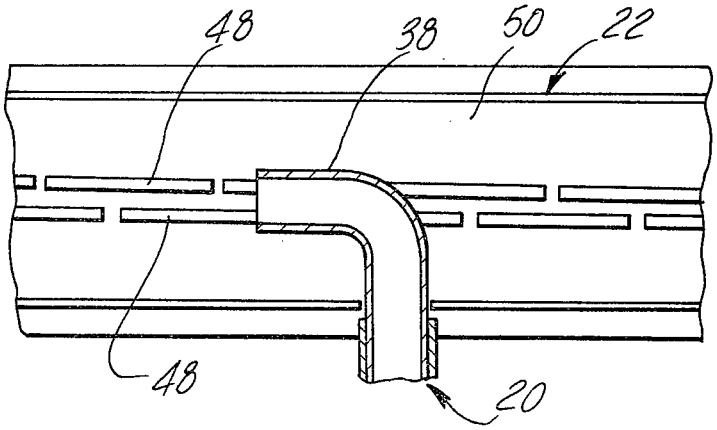
FIG. 5 is a view of section 5—5 taken in FIG. 4.

Referring to FIGS. 4 and 5, an alternate version of this ducting system is depicted, which serves to more efficiently recover the heat lost through the paint curing oven 10 roof and walls and to reduce the leakage of gases from the interior of the paint curing oven into the surrounding shop air.

This arrangement includes the installation of the collector duct 22 directly to roof 42 of the paint curing oven 10, rather than being supported spaced above it, as in the above-described embodiment. Each of the vent stacks 20 associated with the oven heaters 12 has, as before, a terminal elbow fitting 38, directing the exhaust gases into the central region of the collector duct 22, so as to mix the same with the relatively cooler air conditioned within collector duct 22.

Collector duct 22 is placed in communication with an air space 44 located within the paint curing oven roof 42 and walls 46 by a series of longitudinal slots 48 disposed in the outer skin 50 of the paint curing oven roof 42 panels.

The walls and roof of the paint curing oven 10 are formed of sheet metal panels, each having an inner and outer layer spaced apart to define the air space 44. Air space 44 in turn is in communication with the longitudinal slots 48 such that air is drawn upwardly through the air space 44 and into the collector duct 22. Collector duct 22 in this case takes the form of a three-sided, hat-shaped section with the bottom flanges 52 received in a sliding fit within retainer strips 54 so as to accommodate the thermal expansion and contraction of collector duct 22. Thus, the interior of the paint curing oven 10 heating the air contained within air space 44 tends to recover the radiation heat losses from the paint curing oven 10.

At the same time, any leakage tending to occur from the paint curing oven 10 is collected by the induction of air through the collector duct 22 such as to prevent passage of the same into the outer surrounding air.

Accordingly, it can be seen that a more efficient heat collection is achieved by this method and also any leakage which would otherwise occur is minimized or entirely eliminated.

FIGS. 6 through 8 depict a modification of this version. In this case, the paint curing oven 10 is constructed of panel sections, each consisting of an inner sheet metal panel 56, an intermediate insulating layer, as of fiber glass batting 58, faced with a foil layer 60 and with outer metal panels 62 spaced apart from the foil layer 60 such as to provide an air space 64. The collector duct 22 is mounted to the roof 42 of the paint curing oven 10 as in the previous variation with the vent stacks 20 each emptying into the collector duct 22.

Thus, the air moving through air space 64 also serves to collect the escaping or leaking gas from the interior of paint curing oven 10, as well as recovering any final heat losses passing through the insulating layer 58.

The movement of air through air space 64 is facilitated by the provision of louver openings 66 provided at the bottom of each wall panel indicated generally at 68 which provide for the induction of air at the lower-most region of each wall panel 68 and the flow of air through the full height of the wall panel 68.

FIG. 8 depicts a variation of the version shown in FIG. 6, in which a plenum 70 is provided extending along the bottom of the paint curing oven 10 adjacent the louver openings 66. A blower 72 is provided which serves to pressurize the interior of the plenum 70 and cause a positive pressure to be exerted within the air space 64 of each wall panel 68.

This positive pressure tends to preclude any escape of gases due to the greater-than-room pressure existing in the air space 64 such that a slight inflow to the interior of the paint curing oven 10 will occur rather than outflow, thereby preventing the escape of any of the gases from the interior of the paint curing oven 10.

Accordingly, it can be seen that not only is the recovery of heat energy rendered more efficient, but further the paint curing oven is made to operate in a very clean fashion, even though the installation is located within a building structure thus eliminating the need for extensive individual ventilation in the region of the paint curing ovens. All of this has been carried out by relatively low cost and easily installed ducting panel structures which do not require the extensive use of thermal compensation connectors, etc. The outer skins of the paint curing oven are also rendered much cooler such as to reduce the need for increased building air conditioning capacity due to the radiated heat in the vicinity of the paint curing ovens, and improving the comfort level in the building.

The embodiments of the invention in which an exclusive property or privilege is claimed are defined as follows:

1. In combination, a heat recovery system and a paint curing oven of the type including a plurality of fuel-fired heaters, each having an exhaust vent stack directly receiving the exhaust gases from a respective one of said fuel-fired heaters, said system recovering heat from said plurality of paint curing oven fuel-fired heaters and including:

a collector duct extending over each of said paint curing oven heaters;

means for drawing air flow at cooler temperatures through said collector duct;

means for introducing the exhaust gas from each of said paint curing oven fuel-fired heaters into the interior of said collector duct, including ducting means directing the flow from each of said exhaust vent stacks into the interior of said collector duct;

means for extracting heat from said mixture of air and exhaust gas circulated through said collector duct.

2. The system according to claim 1 wherein said means for drawing said flow of cooler air through said collector duct includes means for collecting air warmed over said cooling oven by radiation from said paint curing oven and drawing said air into said collector duct.

3. The system according to claim 2 wherein said means for drawing said flow of air through said collector duct further includes means for collecting warmed air from a secondary heat source and also causing said warmed air to flow into said collector duct.

4. The system according to claim 3 wherein said paint curing oven includes walls and a roof and wherein said means for collecting said flow of warmed air in said collector duct from a secondary heat source includes means forming air spaces in said walls and roof of said paint curing oven, and means for causing air to flow through said space and into said collector duct.

5. The system according to claim 4 wherein said collector duct is mounted directly to the roof of said paint curing oven, and wherein said roof includes an outer panel formed with openings in communication with the interior of said collector duct, whereby said warmed air passes through said slots into said collector duct.

6. The system according to claim 5 further including blower means pressurizing said air space downstream from said roof openings, whereby leakage from the interior of said paint curing ovens is minimized.

7. The system according to claim 1 wherein said ducting means for introducing said exhaust gas into said collector duct comprises ducting fitting connected to said exhaust vent stack extending into the interior of said collector duct and directing said exhaust gas thereinto in a direction substantially aligned with the direction of air flow in said collector duct.

8. The system according to claim 7 wherein said ducting fitting is loosely interfit with the sidewall of the collector duct.

9. A method of recovering heat from a plurality of sources of relatively high temperature gases in a single collector duct, the method including the steps of:

circulating into the interior of said collector duct a volume of lower temperature gas;

introducing the hot gas from each of said plurality of sources into the interior of said collector duct;

collecting heated gases from secondary sources, which heated gases are warmed to a moderate temperature substantially lower than said high temperature gases and above said lower temperature gases circulating said relatively moderately heated gases into said collector duct; and recovering heat energy from said mixture of said high, moderate and lower temperature gases.

10. A method of recovering heat energy in a collector duct and utilizing said energy in utilization equipment from a paint curing oven, said paint curing oven being of the type having a plurality of fuel-fired heaters, each having an exhaust stack vent, said oven including walls and a roof, the method including the steps of:

inducing an air flow in said collector duct extending along said oven;

directing the exhaust flow from each of said heaters into said induced air flow to produce a lower temperature mixture;

extracting heat energy from said mixture;

utilizing said heat energy in said utilization equipment.

11. The method according to claim 10 further including the step of collecting warmed air from secondary heat sources into said collector duct.

12. The method according to claim 11 wherein in said collecting step, air is caused to flow through air spaces formed in said paint curing oven walls and collected into said collector duct.

13. The method according to claim 12 wherein in said collecting step, a positive pressure is created in said air space above the pressure in said paint curing oven to preclude gas leakage from said paint curing oven.

14. A method of providing a cooled and sealed building structure having an interior space defined by walls and a roof comprising the steps of:

forming said building interior space with walls and a roof with inner and outer panels with an air space defined between said inner and outer panels;

pressurizing said air space between each of said panels above the air pressure in said building interior space; and collecting air flow out of said air spaces in common collector duct means in communication with said air space.

* * * * *